United States Patent [19]

Boyce

[11] 3,930,742

[45] Jan. 6, 1976

[54] VELOCITY PROBE FOR COMPRESSOR SURGE CONTROL

[75] Inventor: Meherwan P. Boyce, College Station, Tex.

[73] Assignee: Howell Instruments, Inc., Fort Worth, Tex.

[22] Filed: Oct. 3, 1974

[21] Appl. No.: 511,705

Related U.S. Application Data

[63] Continuation-in-part of Ser. No. 408,809, Oct. 23, 1973.

[52] U.S. Cl. ..... 415/1; 415/11; 415/118; 73/194 R

[51] Int. Cl.[2] ..... F01D 21/14

[58] Field of Search ..... 415/1, 11, 118, DIG. 1; 73/212 R, 194 R, 205 R

[56] References Cited

UNITED STATES PATENTS

| | | | |
|---|---|---|---|
| 1,834,392 | 12/1931 | Fechheimer | 73/212 |
| 3,240,422 | 3/1966 | Pettersen et al. | 415/1 |
| 3,248,043 | 4/1966 | Taplin et al. | 415/1 |
| 3,638,490 | 2/1972 | Buettner | 73/194 |
| 3,677,000 | 7/1972 | Thomson | 415/1 |
| 3,759,098 | 9/1973 | Logsdon et al. | 73/205 R |
| 3,846,038 | 11/1974 | Curriere et al. | 415/1 |
| 3,875,797 | 8/1975 | Zweng | 73/194 R |

FOREIGN PATENTS OR APPLICATIONS

| | | | |
|---|---|---|---|
| 1,120,187 | 4/1956 | France | 415/1 |

*Primary Examiner*—Henry F. Raduazo
*Attorney, Agent, or Firm*—Cushman, Darby & Cushman

[57] ABSTRACT

A method and apparatus for sensing the velocity of a fluid flow, especially within the boundary layer of a fluid flow path through a compressor. A reference flow under constant pressure is established through an orifice dividing two plenum chambers, and directed through a flow sensing opening in a probe positioned in the flow to be sensed. The flow sensing opening is slightly larger than the orifice. A relative pressure indicator connected to the two plenum chambers indicates the velocity of the sensed fluid flow. The flow sensing opening is arranged so that the normal reference flow of fluid therethrough is in the same direction as the normally expected flow direction of the flow to be sensed.

11 Claims, 3 Drawing Figures

VELOCITY PROBE FOR COMPRESSOR SURGE CONTROL

CROSS REFERENCE TO RELATED APPLICATION

This application is a Continuation-in-Part of Application Ser. No. 408,809 filed Oct. 23, 1973 entitled: "METHOD AND APPARATUS FOR COMPRESSOR SURGE CONTROL", and the subject matter of that application is hereby wholly incorporated by reference in the present application.

BACKGROUND AND SUMMARY OF THE INVENTION

The invention relates to a velocity probe for measuring the velocity of a fluid stream, and particularly for measuring the change in flow patterns of a fluid stream. Prior art devices have had several problems associated therewith. Many prior art devices in the general field of the invention, such as that shown in U.S. Pat. No. 3,759,098, require at least two sets of orifices within members disposed within a flow stream, or within the flow stream confining member itself. This may require extra expense and the necessity of forming a plurality of orifices (which should be sealed) within structural members, affecting the transferability of a measuring device from one system to another. Also, many prior art devices, U.S. Pat. No. 1,834,392 for example, have a tendency to clog up when placed in the flow stream if the fluid has impurities and contaminants therein.

According to the teachings of the present invention, the above problems are avoided. A velocity probe is provided that has only a single connection to a chamber confining a fluid stream to be sensed. The probe has an opening in a sensing portion thereof that is orientated in a particular manner so that the probe opening will not clog up during normal use in a contaminated fluid stream, yet will effectively sense the velocity of the stream.

The velocity probe of the present invention is especially useful in sensing the flow reversal occurring in the boundary layer of material flowing through a compressor and thereby controlling impending surge conditions in a compressor, as more fully described in the abovementioned parent application Ser. No. 408,809. The probe of the present invention is adapted to be inserted into the boundary layer of material flowing through a compressor, and will not clog up as a result of the contaminated flow often associated with a compressor.

DETAILED DESCRIPTION OF THE INVENTION

Figure 1:
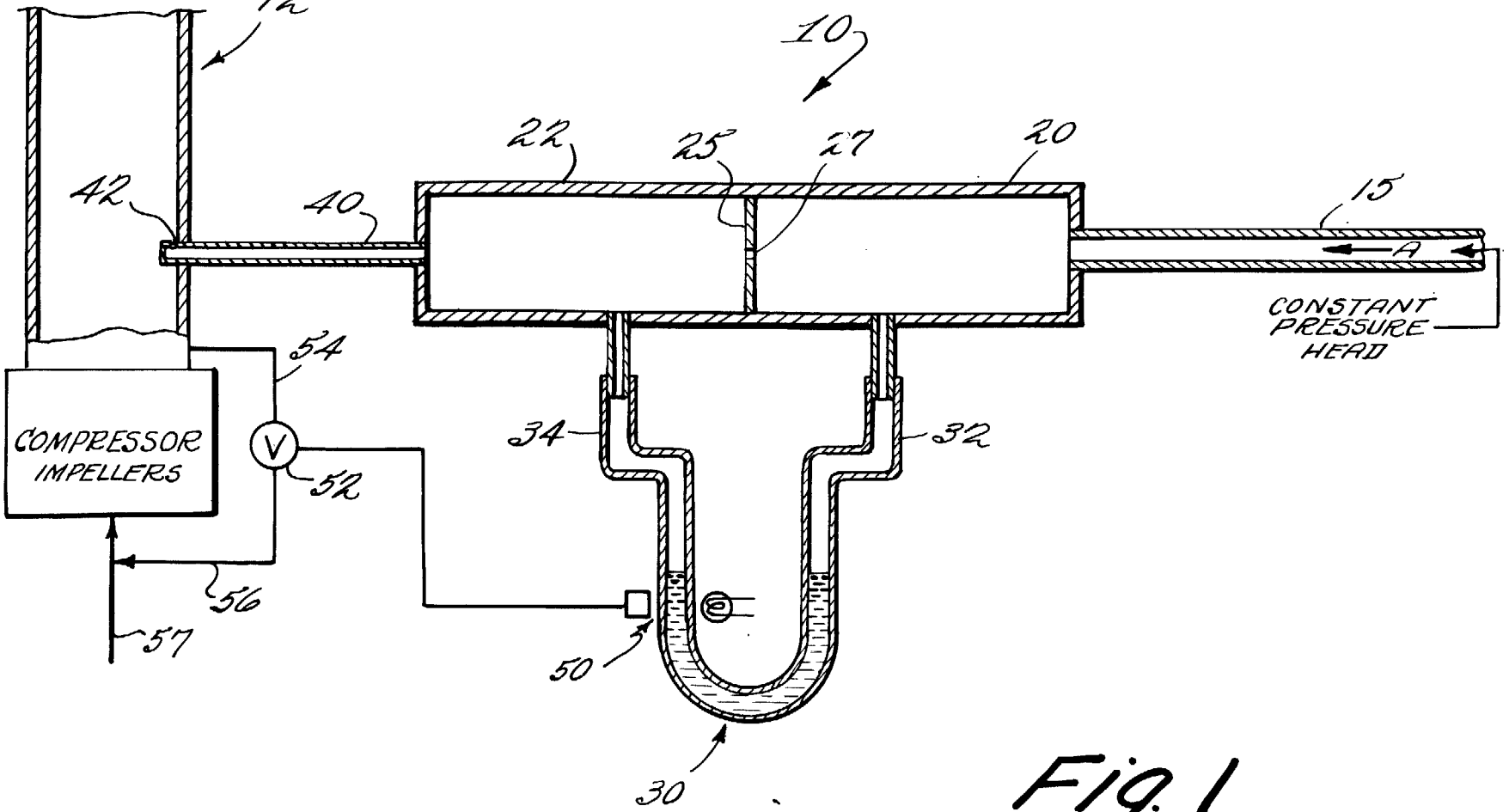
FIG. 1 is a schematic cross-sectional view of a probe according to the present invention with the probe arranged to sense the fluid flow velocity of the boundary fluid layer in the outlet or discharge chamber of a compressor.

A velocity probe, shown generally at 10, for sensing the fluid flow in a chamber, shown generally at 12, is depicted in FIG. 1. The probe consists of a supply conduit 15 for supplying fluid at a constant pressure to a pair of plenum chambers, 20 and 22. The plenum chambers function as transient energy storage means to remove pulsations from the flow of fluid to an indicating means, such as the differential gauge shown generally at 30. Since separate plenum chambers are provided for the supply conduit 15 and for the conduit 40 connected to the flow to be sensed in chamber 12, it follows that pulsations from either source are effectively damped by the plenum chambers.

A plate 25 having an orifice 27 therein is disposed between the plenum chambers 20 and 22. The orifice 27 restricts the flow of fluid from one chamber to the other and is so dimensioned that substantial pressure drop occurs thereacross and so that the drop is linear with respect to the sensed flow velocity in the flow range of interest. The flow A of fluid from the supply conduit 15 takes a path through chamber 20, through orifice 27, to chamber 22, through probe sensing portion 40, and out through probe opening 42. The quantity of flow A is determined by the pressure of the fluid supplied through conduit 15 and the size of orifice 27.

The probe sensing portion 40 is at least partially inserted within the chamber 12 to sense both the direction and magnitude — which is proportional to the pressure, the pressure of the flow A being known — of the flow within chamber 12. The sensing portion 40 is relatively thin so as not to affect the flow in the chamber in which it is injected. In the case where the probe 10 is used to sense flow reversal in a boundary layer of material flowing through a compressor, it is located adjacent the wall of chamber 12, near the compressor outlet as shown in the drawings. The probe opening 42 is orientated with respect to the chamber 12 and the sensing portion 40 so that fluid passing from the interior of sensing portion 40 through opening 42 has the same direction as the normally expected direction of the normal fluid flow B within the chamber 12; that is the opening 42 is protected from any fluid flow contaminants within the chamber 12 by the back surface of the sensing portion 40 within the chamber 12. Even when the flow is quite contaminated, it only impinges on opening 42 for a slight period of time during normal operation of the device so no clogging of the opening 42 will normally result. However, even if slight clogging thereof should result, the normal flow A of fluid after the reversal in chamber 12 has been sensed will usually result in automatic purging of the contaminants from the opening 42 and conduit 40.

The probe opening 42 — and the conduits 15 and 40 — are made slightly larger than the orifice 27 so that flow restriction will occur only at orifice 27. The opening 42 may be only slightly larger than the orifice 27, however, otherwise the pressure gauge 30 will indicate an impractically large pressure difference in the static condition of the device (FIG. 1).

Figure 2:
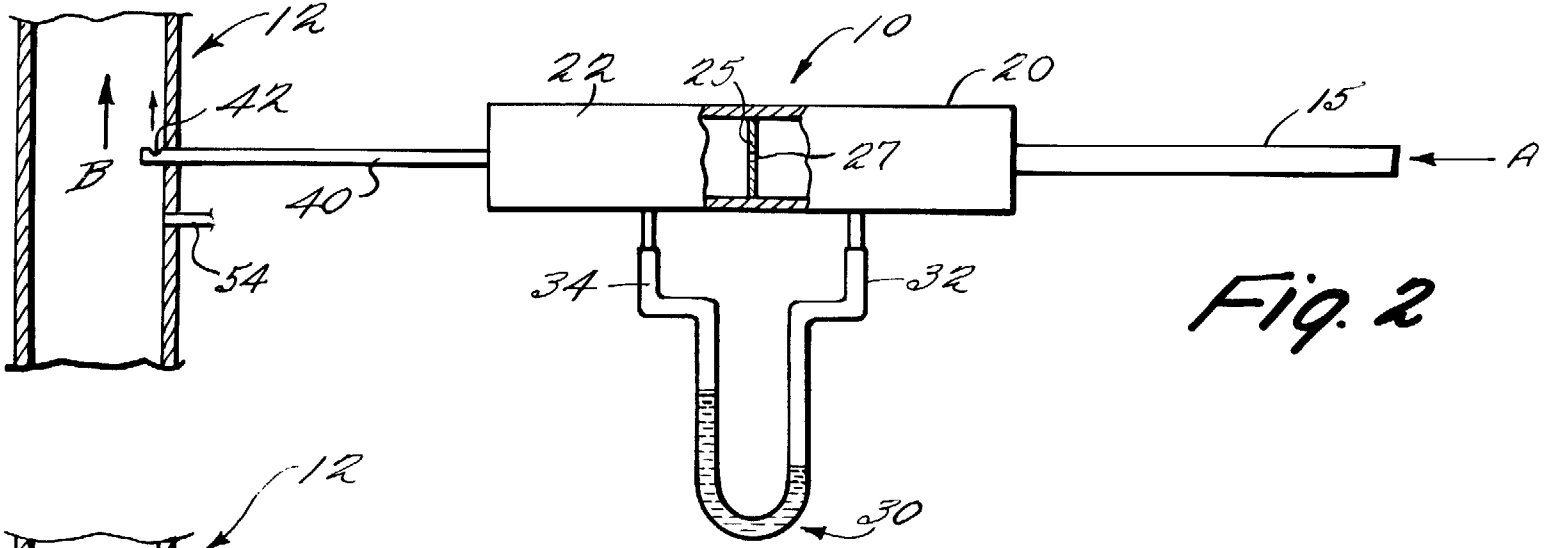
FIG. 2 is a schematic view of the probe shown in FIG. 1 with the fluid to be sensed flowing in the normal flow direction.

The probe 10 is shown sensing a static air condition in chamber 12 in FIG. 1. In this case, the steady state pressure in chambers 20 and 22 is substantially equalized, therefore the heights of the liquid in legs 32 and 34 of differential gauge 30 are substantially the same. A normal flow condition in chamber 12 is shown in FIG. 2. Here the flow B in chamber 12 is in the same direction as the fluid coming from the opening 42 in sensing portion 40 as a result of the constant pressure A. The flow B causes the flow of fluid through the opening 42 to be much more rapid than it is under static conditions within chamber 12, thus fluid from flow A cannot bleed fast enough through orifice 27 to make up for the loss, and a pressure differential between the chambers 20 and 22 results. The pressure in chamber 20 will be greater than the pressure in chamber 22 by an amount proportional to the velocity of the flow B in chamber 12. The legs 32 and 34 of the differential gauge 30 may be calibrated to indicate the magnitude of the difference.

Figure 3:
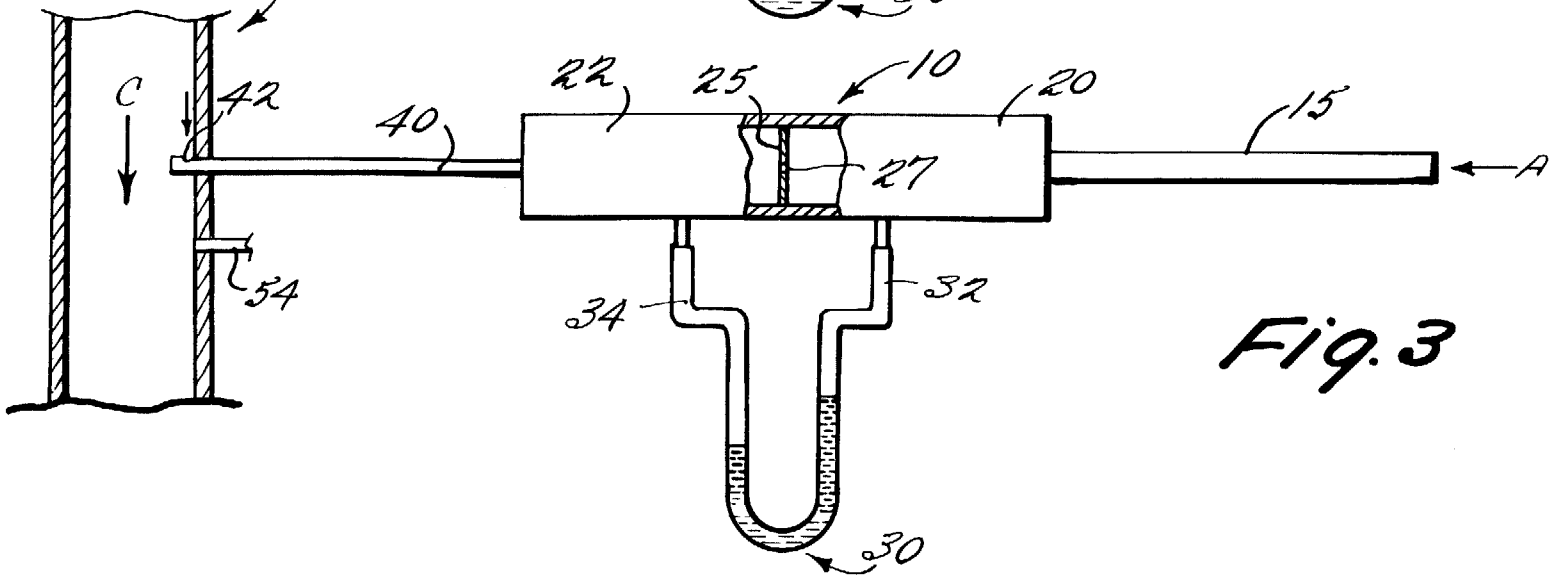
FIG. 3 is a schematic view of the probe shown in FIGS. 1 and 2 with the probe sensing a reversal of boundary layer fluid flow from the direction shown in FIG. 2.

An abnormal flow direction C is shown in FIG. 3. The flow C is a result of a reversal of the normal flow direction B in chamber 12 (such as ensues in the boundary layer flow impending surge in a compressor), and this flow reversal is sensed by the probe 10 as shown in FIG. 3. In this case, the flow C will impinge directly on the surface of the sensing portion 40 having opening 42 therein, resulting in some fluid flow entering opening 42, and consequently increasing the pressure within the chamber 22 over that in the chamber 20. This pressure differential is sensed by the differential gauge 30 as the liquid within legs 32, 34 moves to the position indicated in FIG. 3. Again the legs 32 and 34 may be calibrated to indicate the magnitude of the pressure difference.

In the method of operation of the exemplary velocity probe illustrated, a reference flow A under constant pressure is established in conduit 15, damped in plenum chamber 20, and then restricted by orifice 27 in divider 25. During normal conditions, it then is expanded in plenum chamber 22, and passes through conduit 40 and opening 42 along a path whereby it is directed in the same direction as the normal flow direction B in chamber 12. The indicating means 30 senses the pressure differential on either side of flow restricting means 25, 27. When flow reversal to direction C occurs in chamber 12, part of reversed flow C passes through opening 42 against the pressure of the reference flow A (or causes the "backing up" of fluid flow A through opening 42), oscillations in the back-flow being damped by the plenum chamber 22.

Pressure differential on either side of restricting means 25, 27 is again sensed by indicating means 30. As shown in FIG. 1, the indicating means 30 may also be operatively connected to a control for a compressor connected to the chamber 12. Such a means may take the form of a simple light source and photoelectric cell, indicated generally at 50, which controls an electrically controlled valve 52 in response to the level of liquid in pressure gauge 30. The valve 52 when operated then allows a small portion of boundary layer fluid at the outlet of the compressor to bleed through lines 54 and 56 back to the compressor inlet 57 to delay the onset of surge (as more fully explained in copending parent application No. 408,809). Of course other suitable sensing means could be used, or alternatively, after visually reading the indicating means 30 an operator could appropriately act on the compressor connected to chamber 12.

It will thus be seen that a velocity probe, and velocity sensing method, have been provided that include means for damping out any pulsations in a flow to be sensed and/or in a reference flow, a probe that provides a reference flow, a probe that will not be impaired or fail to function even when sensing a contaminated flow, a probe that is substantially self correcting even if contaminated by brief exposure to a contaminated reverse flow, and one that is capable of sensing both the direction and magnitude of a fluid flow while not substantially affecting the flow it senses. Although the invention has been disclosed in what is presently conceived to be the most practical and preferred embodiment, it will be obvious to one of ordinary skill in the art that many modifications of the velocity probe and method of the invention may be made within the scope of the invention, which scope is not to be limited except by the appended claims.

What is claimed is:

1. In combination, a compressor having a fluid inlet and a fluid outlet in which fluid outlet a flow of fluid is to be sensed, and a velocity probe assembly for sensing the velocity of fluid flow, said assembly comprising, a. first and second plenum chambers, b. a divider between said plenum chambers, c. an orifice in said divider for providing limited fluid communication between said first and second chambers, d. indicating means for sensing the pressure differential between said chambers, e. means for supplying a source of fluid under constant pressure to said first plenum chamber, f. a sensing portion leading from and in fluid communication with said second plenum chamber, said sensing portion having an opening therein larger than said orifice and being mounted in the compressor adjacent a wall thereof near its outlet and situated in the boundary layer of the material flowing in the compressor outlet for detecting flow direction reversal in said boundary layer and thus detecting an impending surge condition.

2. A combination as recited in claim 1 wherein said sensing portion is disposed within said outlet such that fluid flowing through said opening from the interior of said sensing portion will have substantially the same direction as the direction of normally expected fluid flow in said outlet.

3. A combination as recited in claim 2 including a bleed line extending between the boundary fluid layer in the compressor outlet and the compressor inlet, said bleed line having a valve positioned therein, said indicating means having means responsive to said indicating means functioning to operate said valve to bleed back a portion of the boundary layer fluid at the outlet of the compressor back into the inlet when flow reversal in said outlet boundary layer occurs so as to eliminate the flow reversal and delay the onset of surge conditions.

4. In combination:

a compressor having a fluid inlet and a fluid outlet in which fluid outlet a flow of fluid is to be sensed, and a velocity probe assembly for sensing the velocity of fluid flow, said assembling comprising, a. means for supplying a source of fluid under constant pressure, b. means for restricting the flow of fluid from said source, c. means for damping out pulsations in said fluid flow under constant pressure and in a flow to be sensed, said means including first and second plenum chambers located on either side of said means for restricting the flow of fluid from said source, said first plenum chamber being in communication with said source of fluid under constant pressure, d. indicating means for indicating the pressure differential between said first and second plenum chambers, e. a sensing portion leading from and in fluid communication with said second plenum chamber, said sensing portion having an opening therein larger than said restricting means and being mounted in the compressor adjacent a wall thereof near its outlet and situated in the boundary layer of the material flowing in the compressor outlet for detecting flow direction reversal in said boundary layer and thus detecting an impending surge condition.

5. A combination as recited in claim 4 further comprising means for ensuring that said opening in said sensing portion is not closed or constricted by contaminants in said fluid flow to be sensed, said means including location of said opening in said sensing portion so that fluid flowing therethrough will have substantially the same direction as the normally expected direction of fluid flow to be sensed.

6. A combination as recited in claim 4 wherein said means for restricting the flow of fluid from said source includes a divider between said first and second plenum chambers having an orifice therein, said orifice being smaller than the opening in said sensing portion so that flow restriction occurs only at said orifice.

7. A combination as recited in claim 4 wherein said indicating means includes a leg conduit connected at one end to said first plenum chamber, a leg conduit connected at one end to said second plenum chamber, means connecting said legs in common fluid communication at their remaining ends, and a fluid responsive to the pressure differential between said plenum chambers disposed within said means connecting said legs.

8. A combination as recited in claim 4 including a bleed line extending between the boundary fluid layer in the compressor outlet and the compressor inlet, said bleed line having a valve positioned therein, said indicating means having means responsive to said indicating means functioning to operate said valve to bleed back a portion of the boundary layer fluid at the outlet of the compressor back into the inlet when flow reversal in said chamber boundary layer occurs so as to eliminate the flow reversal and delay the onset of surge conditions.

9. A method of sensing the velocity of fluid flowing in a compressor outlet and for controlling the compressor thereby, comprising the steps of a. establishing a first flow of fluid under constant pressure, b. damping out pulsations in said first fluid flow at a damping position, c. restricting said first fluid flow at a restricting position downstream of said damping position, d. allowing expansion of said first fluid flow at an expansion position downstream of said restricting position, e. establishing said first fluid flow along a path to said compressor outlet, f. sensing the pressure differential between said expansion position and said damping position, and g. controlling the by-passing of boundary layer fluid from the outlet of a compressor to its input in dependence upon the pressure differential sensed between said expansion and damping positions.

10. A method as recited in claim 9 comprising the further step of insuring that contaminants in said flow to be sensed will not interfere with sensing of said flow by establishing said first fluid flow along a path to said compressor outlet in a direction substantially the same as the normally expected direction of flow to be sensed in said compressor outlet.

11. A method as recited in claim 10 comprising the further step of damping out pulsations in said flow to be sensed, when flowing in a direction opposite said normally expected direction, at said expansion position.

* * * * *